US011486641B2

(12) United States Patent
Gümbel

(10) Patent No.: US 11,486,641 B2
(45) Date of Patent: Nov. 1, 2022

(54) APPARATUS AND METHOD FOR CONTROLLING THE TEMPERATURE OF WORKPIECES

(71) Applicant: EISENMANN SE, Böblingen (DE)

(72) Inventor: Urs Gümbel, Nürtingen (DE)

(73) Assignee: EISENMANN GMBH, Böblingen (DE)

( * ) Notice: Subject to any disclaimer, the term of this patent is extended or adjusted under 35 U.S.C. 154(b) by 109 days.

(21) Appl. No.: 16/764,371

(22) PCT Filed: Nov. 7, 2018

(86) PCT No.: PCT/EP2018/080406
§ 371 (c)(1),
(2) Date: May 14, 2020

(87) PCT Pub. No.: WO2019/096638
PCT Pub. Date: May 23, 2019

(65) Prior Publication Data

US 2020/0271384 A1 Aug. 27, 2020

(30) Foreign Application Priority Data

Nov. 16, 2017 (DE) ..... 10 2017 126 978.9

(51) Int. Cl.
*F26B 21/10* (2006.01)
*F25B 21/02* (2006.01)
(Continued)

(52) U.S. Cl.
CPC ..... *F26B 21/10* (2013.01); *F25B 21/02* (2013.01); *F26B 15/18* (2013.01); *F26B 25/10* (2013.01); *F26B 25/12* (2013.01); *F26B 2210/12* (2013.01)

(58) Field of Classification Search
CPC ..... F26B 21/10; F26B 21/02; F26B 15/18; F26B 25/10; F26B 25/12; F26B 2210/12
(Continued)

(56) References Cited

U.S. PATENT DOCUMENTS 3,851,402 A * 12/1974 Turnbull ..... B05D 3/046 34/548
4,771,552 A * 9/1988 Morioka ..... F26B 21/006 34/222
(Continued)

FOREIGN PATENT DOCUMENTS

CA 1 336 537 C 8/1995
CN 16 68 884 A 9/2005
(Continued)

*Primary Examiner* — Stephen M Gravini
(74) *Attorney, Agent, or Firm* — Schroeder Intellectual

(57) ABSTRACT

An apparatus for controlling the temperature of workpieces, in particular of vehicle bodies, has a temperature-control tunnel, a traction chamber and an intermediate floor which is arranged between the temperature-control tunnel and the traction chamber and which has a connection passage. The apparatus includes a conveying device for conveying the workpieces in the temperature-control tunnel, wherein the conveying device has at least one conveying carriage with a running gear and has a workpiece carrier for holding the workpieces of which the temperature is to be controlled. The running gear is arranged in the traction chamber and is connected by a connecting device, which projects through the connection passage of the intermediate floor, to the workpiece carrier arranged in the temperature-control tunnel. To control the temperature of the traction chamber and thus adequately protect the running gear against heat or cold, the intermediate floor is equipped at least in regions with an active cooling and/or heating means.

10 Claims, 3 Drawing Sheets

(51) Int. Cl.
*F26B 15/18* (2006.01)
*F26B 25/10* (2006.01)
*F26B 25/12* (2006.01)

(58) Field of Classification Search
USPC ..... 34/47, 666
See application file for complete search history.

(56) References Cited

U.S. PATENT DOCUMENTS 5,568,692 A * 10/1996 Crompton ..... F26B 3/283 34/270
5,657,555 A * 8/1997 Milojevic ..... F26B 3/283 34/271
6,935,052 B2 * 8/2005 Sonner ..... F26B 15/12 34/219
7,181,864 B1 * 2/2007 Coss ..... F26B 5/14 34/380
7,260,901 B2 8/2007 Doll
7,600,329 B2 * 10/2009 Ortlieb ..... B65G 13/11 34/666
7,658,017 B1 * 2/2010 Laviolette ..... F26B 5/042 34/403
10,184,720 B2 * 1/2019 Binder ..... F26B 15/08
10,359,234 B2 7/2019 Robbin
10,584,920 B2 * 3/2020 Iglauer ..... F26B 25/001
10,676,283 B2 * 6/2020 Gumbel ..... B65G 69/20
10,697,702 B2 * 6/2020 Iglauer ..... F26B 21/004
11,112,177 B2 * 9/2021 Iglauer ..... F26B 25/001
11,167,305 B2 * 11/2021 Schwab ..... B05B 16/20
2006/0055091 A1 3/2006 Doll
2018/0120028 A1 5/2018 Robbin
2020/0271384 A1 * 8/2020 Gumbel ..... F26B 25/12

FOREIGN PATENT DOCUMENTS

CN 18 29 888 A 9/2006
DE 10 2015 006 098 A1 11/2016
DE 10 2015 114 854 A1 3/2017
DE 102016004484 A1 * 10/2017 ..... B05B 13/0452
EP 3715230 A1 * 9/2020 ..... B65G 69/20
JP H04-118168 U 10/1992
JP H07313920 A 12/1995
WO WO-2017178317 A1 * 10/2017 ..... B05B 13/0452

* cited by examiner

APPARATUS AND METHOD FOR CONTROLLING THE TEMPERATURE OF WORKPIECES

RELATED APPLICATIONS

This application is a national phase of International Patent Application No. PCT/EP2018/080406 filed Nov. 7, 2018, which claims priority to German Patent Application No. 10 2017 126 978.9 filed Nov. 16, 2017—the contents of all of which are incorporated herein by reference.

BACKGROUND OF THE INVENTION

1. Field of the Invention

The invention relates to an apparatus for controlling the temperature of workpieces, in particular of vehicle bodies, comprising a) a temperature control tunnel,
b) a tunnel tube,
c) an intermediate floor, which is arranged between the temperature control tunnel and the tunnel tube and has a connecting passage,
d) a conveying device for conveying the workpieces in the temperature control tunnel,
e) wherein the conveying device has at least one trolley having a running gear and a workpiece carrier for receiving the workpieces to be temperature-controlled, wherein the running gear is arranged in the tunnel tube and, with a connecting device which projects through the connecting passage of the intermediate floor, is connected to the workpiece carrier arranged in the temperature control tunnel.

The invention further relates to a corresponding method for controlling the temperature of workpieces, in particular of vehicle bodies.

2. Description of the Prior Art

Above all from the automotive industry sector, surface treatment plants in which workpieces, in particular vehicle bodies, are subjected to various surface treatments are known. Thus vehicle bodies are washed, for instance, in dipping baths or subject to dip-coating treatments.

After surface treatments of this type, a temperature controlling of the workpieces, in particular a drying, which is typically associated with a heating of the workpieces, is often necessary. This can serve for the removal of treatment liquid residues and/or solvent residues. The temperature controlling can, however, also be necessary to initiate or to end chemical processes, such as, for instance, the curing of a lacquer.

For this purpose, it is already known to lead the workpieces with a conveying device through a temperature control apparatus of the surface treatment plant.

For a surface treatment plant, there has here been developed by the Applicant a conveying device which allows the actual workpiece to be led in a temperature control tunnel which is substantially separated from a tunnel tube in which a running gear of the conveying device is found. As a result, dirt contaminations of the workpiece which stem from moving parts of the conveying device are kept as small as possible. By way of example, for such a conveying device, reference should be made to DE 10 2015 006 098 A1.

Since in the temperature control apparatuses, however, temperatures of up to around 240° C. can sometimes prevail, it has been shown that heat-sensitive components, above all the moving and electronic parts, of the running gear, in spite of their arrangement in the tunnel tube, can suffer damage.

SUMMARY OF THE INVENTION

It is therefore an object of the present invention to define an apparatus of the type stated in the introduction, in which the running gear of the conveying device in the tunnel tube is better protected from excessively high and/or excessively low temperatures.

It is further an object of the invention to define a corresponding method for controlling the temperature of workpieces.

According to the invention, this object is achieved by an apparatus of the type stated in the introduction, in which f) the intermediate floor, at least in some regions, is equipped with an active cooling and/or heating system in order to control the temperature of the tunnel tube.

The inventor has recognized that it is only insufficiently possible to shield the tunnel tube from the temperature control tunnel by thermal technology if the intermediate floor between the temperature control tunnel and the tunnel tube is designed as a passive heat shield. For it has been shown that an appropriate heat shield, for instance made of a sandwich material, is too complex or costly to produce and, moreover, would have too thick a structure. For, in order to provide space for a passive heat shield of this kind, the connecting device which connects the running gear to the workpiece carrier through the intermediate floor would have to be lengthened in order for the running gear and the workpiece carrier to be spaced sufficiently far apart. In particular in the case of a monorail system, this would result in unfavorable leverage ratios, which would make the workpiece carrier, and hence the workpiece to be transported, sway strongly.

The inventor has therefore recognized that, despite a, moreover, otherwise temperature-controlled temperature control tunnel, it can be favorable to provide the intermediate floor toward the tunnel tube, according to requirement, with an active cooling and/or heating system in order also to control the temperature of the tunnel tube.

With the aid of an active cooling and/or heating system of this kind, within a lesser overall height than when a passive heat shield is used, a sufficiently large heat shielding can be achieved at the running gear. As a result, excessively high or excessively low temperatures are avoided there.

Within the scope of the present invention, with respect to the conveying device, both a conveyance through the temperature control tunnel and an inbound transport of the workpieces and, in the reverse direction, their outbound transport, can be meant. In addition, the conveying device can be, for instance, a monorail, a chain conveyor or an electric overhead conveyor.

Depending on the conveying device which is used, the intermediate floor can also be arranged above as a suspended ceiling, such as, for instance, in an electric overhead conveyor, but also at the side.

Although the most frequent application will probably be the active cooling of the intermediate floor in a dryer or kiln of a surface treatment plant, through the usage of an active heating system heating can also conversely be carried out in a cooling region of the temperature control tunnel in the direction of the tunnel tube.

Advantageous refinements of the invention are stated in the subclaims.

Thus, it can advantageously be provided, for instance, that the active cooling and/or heating system comprises a cavity, which is arranged in the intermediate floor and is designed to be flowed through with a cooling or heating medium.

For this purpose, appropriate cooling and/or heating means can be connected to the cavity.

Also the supplies can here be realized both along a direction of conveyance of the conveying device and in the transverse direction thereto.

It can advantageously be provided that the active cooling and/or heating system comprises a plurality of cavities, which are arranged in the intermediate floor.

This makes it possible to control the temperature of different regions differently. Here too, the cavities in the direction of conveyance or transversely hereto can be arranged and/or designed differently. In particular, the plurality of cavities can be designed to be flowed through with cooling medium or heating medium at different temperature, with different throughput and/or with different thermal capacity.

The plurality of cavities can also be arranged close together such that a cavity lying closer to the temperature control tunnel has a different cooling or heating output than a cavity lying closer to the tunnel tube.

Advantageously, it can be provided that the plurality of cavities have different flow cross sections.

As a result, different cooling or heating capabilities can likewise be delivered.

Also, the plurality of cavities can be supplied individually, in groups and/or jointly.

In addition, the cooling or heating medium can be a gas or a liquid, whose flow through the cavity or the plurality of cavities is generated by a tailor-made fan or a pump. Alternatively or additionally, a fan and/or a pump which are provided as part of the temperature controlling for other objects can also, however, be used for this purpose, so that the appropriate cooling or heating medium basically constitutes a branch flow from other anyway present flow systems.

The cavity or the plurality of cavities can here be a component part of an open or a closed flow system. For instance, the line section formed by the cavity can be arranged in a thermal circuit both in the primary circuit of a dryer (for instance heating zone) and in the secondary circuit (for instance cooling zone).

Advantageously, as the cooling or heating medium, the workshop air, which typically has temperatures in the region of around 20-30° C., can also be used. As a result, no additional cooling or heating units become necessary.

Inter alia, a regulation of the cooling or heating output can be realized by globe valves, butterfly valves and/or gate valves in appropriate conduits A change in rotation speed of the fans or pumps can also, however, be realized directly.

Advantageously, in one region of the intermediate floor can be provided a plurality of air outlet openings, which are connected to the cavity or the plurality of cavities. This enables the active cooling or heating of the intermediate floor to be used to create an air curtain.

Advantageously, the hollow chamber structures which form the cavity or the plurality of cavities are constructed in the form of extruded profiles, preferably from plastic or aluminum.

Instead of providing cavities which are flowed through by a cooling or heating medium, it can advantageously also be provided that the active cooling and/or heating system comprises a Peltier element or a heating element.

As a result, the active cooling and/or heating system is able to be actuated completely electrically, without the need to provide installations for the conveyance of the cooling or heating medium. Through the use of a Peltier element or a heating element, the total thickness of the intermediate floor, above all in the vicinity of the connecting passage, can also once again be reduced in relation to a variant with cavities.

Of course, a Peltier element or a heating element can also be provided in addition to an active cooling and/or heating means of a cavity. In this case, at least a corresponding cooling or heating output support is obtained.

Advantageously, it can be provided that the intermediate floor has a collecting region, in particular a collecting channel, in which condensate from the air of the temperature control tunnel can collect.

For this, an appropriate slope of the intermediate floor to the collecting region can be provided, wherein the slope can run both transversely and in the direction of conveyance. In particular, the intermediate floor, starting from the connecting passage, can slope down toward the outside and a collecting channel or a drip edge can be arranged at a distance from the connecting passage. As a result, the condensate moves away from the connecting passage, so that the underlying running gear is not dirtied.

Advantageously, it can be provided that the intermediate floor has an insulating layer.

With the aid of such an insulating layer and with a view to the condensation through an actively cooled region of the intermediate floor, the dew point can be displaced such that it lies within the intermediate floor. This is usually achieved by a suitably dimensioned insulating layer, which, in the case of a dryer, points in the direction of the temperature control tunnel.

Advantageously, it can be provided that the active cooling and/or heating system is designed to control the temperature to differing extent along a direction of conveyance of the conveying device.

This makes it possible, for instance, in different temperature control zones, to also control the temperature of the tunnel tube with a different cooling or heating output. The cooling or heating output can here be adapted in dependence on the temperatures prevailing in the temperature control tunnel.

This latter can also be provided irrespective of a change in the temperature controlling along the direction of conveyance.

Advantageously, it is provided that the active cooling and/or heating system is dimensioned such that, at the provided temperatures of the dryer tunnel, the temperatures of heat-sensitive components of the running gear in the tunnel tube can be limited to a range of maximally 60° C. or minimally 0° C., in particular maximally 40° C. or minimally 20° C. In this temperature range, for instance, the moving components of the running gear, or other components consisting of a typical plastics material, normally suffer no damage, so that a dimensioning of the cooling or heating output should be geared to this temperature range.

In addition, it can be provided that the active cooling and/or heating system comprise a regulating facility in order that the specified maximum temperatures, or, in the case of a cooling, the corresponding minimum temperatures, are observed.

With respect to the method for controlling the temperature of workpieces, the following steps are provided:

a) provision of an apparatus for controlling the temperature of workpieces, according to one of the above-stated refinements;

b) temperature controlling of the workpieces, wherein the intermediate floor is actively cooled or heated.

BRIEF DESCRIPTION OF THE DRAWINGS

Illustrative embodiments of the invention are explained in greater detail below with reference to the drawings, in which.

DESCRIPTION OF PREFERRED ILLUSTRATIVE EMBODIMENTS

Figure 1:
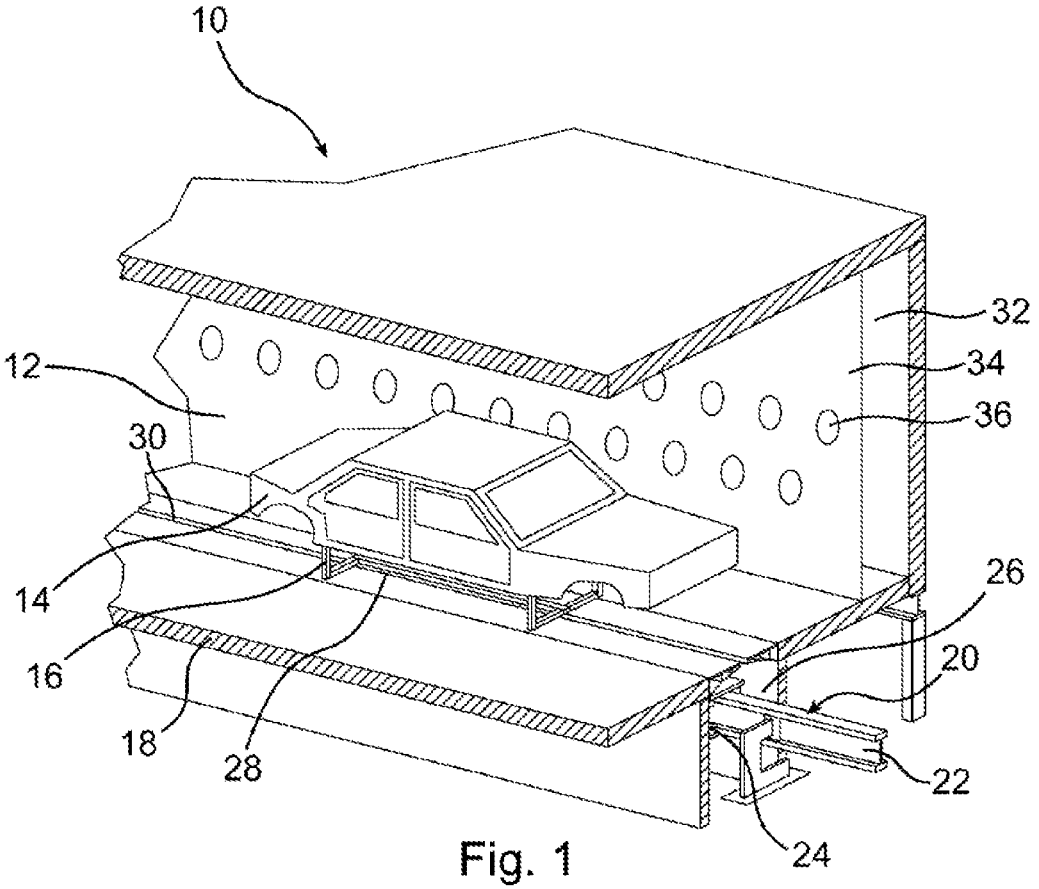
FIG. 1 shows a perspective view of an apparatus according to the invention for controlling the temperature of workpieces, comprising a temperature control tunnel and a tunnel tube which is separated from the temperature control tunnel by an intermediate floor.

FIG. 1 shows a temperature control apparatus, denoted by 10, which is here configured as a dryer. The temperature control apparatus 10 has a temperature control tunnel 12, in which a workpiece 14 to be temperature-controlled, here a vehicle body, is arranged.

The workpiece 14 is located on a workpiece carrier 16, which, above an intermediate floor 18, is moved through the temperature control tunnel 12.

To this end, a conveying device 20 comprising a monorail 22, which is arranged beneath the intermediate floor 18 and along which a running gear 24 moves in a tunnel tube 26, is provided.

For this, the running gear 24 is connected to the workpiece carrier 16 via a connecting device 28, which can be seen more closely from FIGS. 2 to 5. The connecting device 28 passes for this purpose through a connecting passage 30 in the intermediate floor 18, wherein as an additional dirt barrier over the connecting passage 30 there is arranged a shutter 31 (cf. FIGS. 3 to 5), the slats of which are pushed aside by the connecting device 28.

Figure 2:
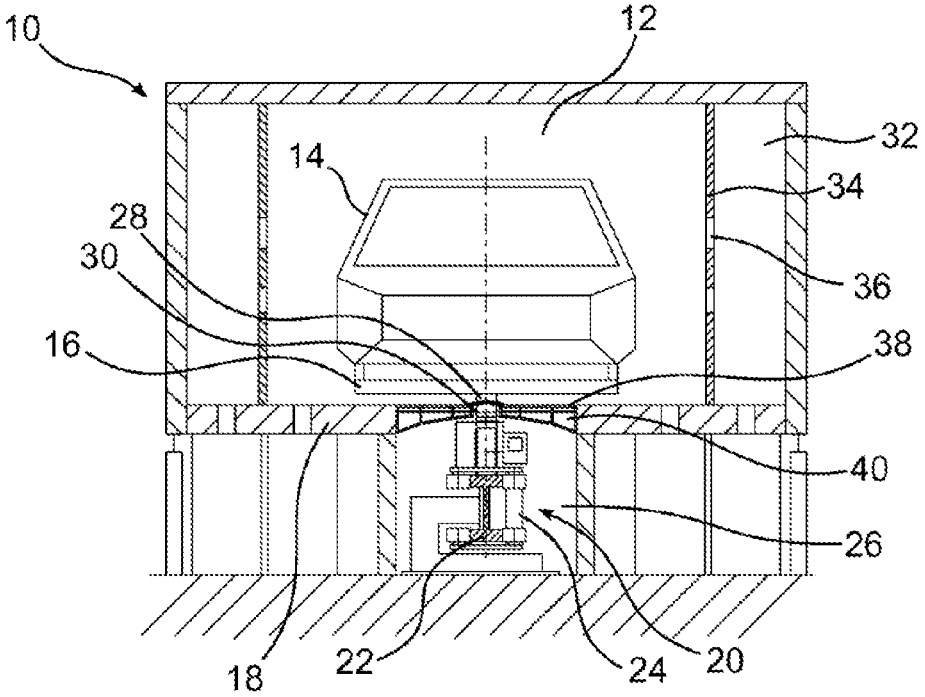
FIG. 2 shows a cross section through the apparatus from FIG. 1.

In addition, the here shown temperature control apparatus 10, as can be seen from FIG. 2, has lateral supply air ducts 32, which are delimited from the temperature control tunnel 12 by a partition wall 34. The partition wall 34 has outlet openings 36, out of which passes hot air for controlling the temperature of, in the present case in particular for drying, the workpiece 14.

Figure 3:
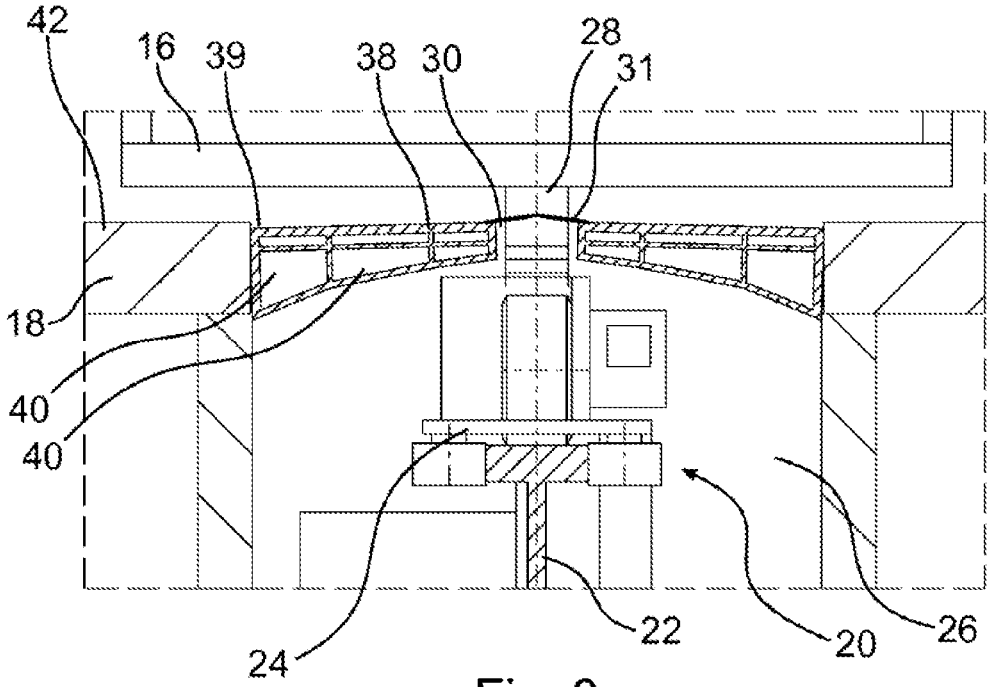
FIG. 3 shows an enlarged detail from the cross section according to FIG. 2, which more closely shows the region of the intermediate floor around a connecting passage.
Figure 4:
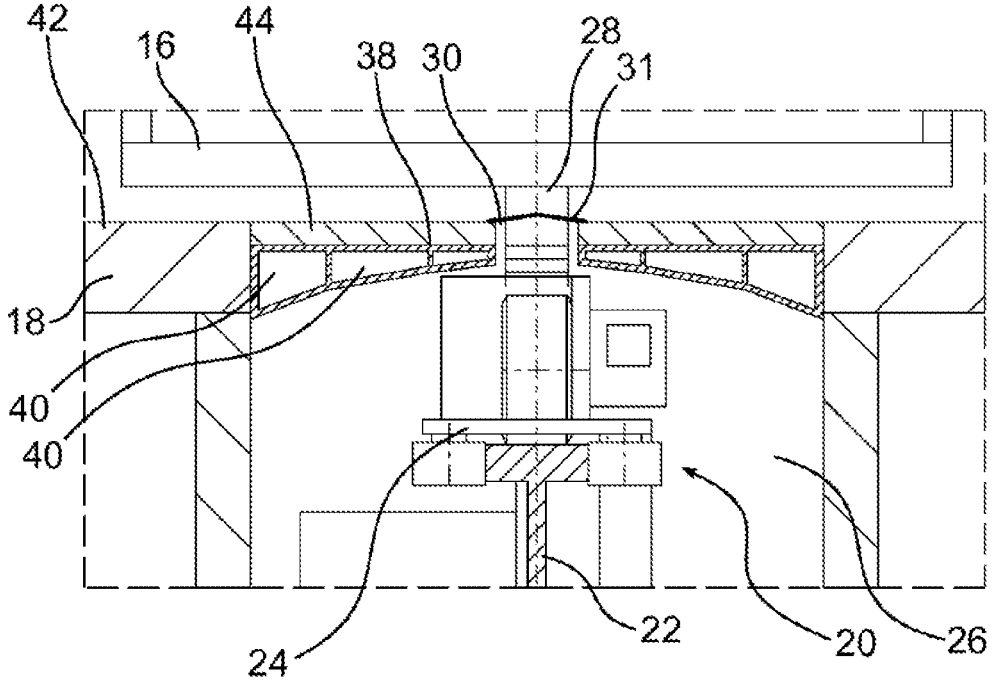
FIG. 4 shows an enlarged detail, in accordance with FIG. 3, of an alternative illustrative embodiment.
Figure 5:
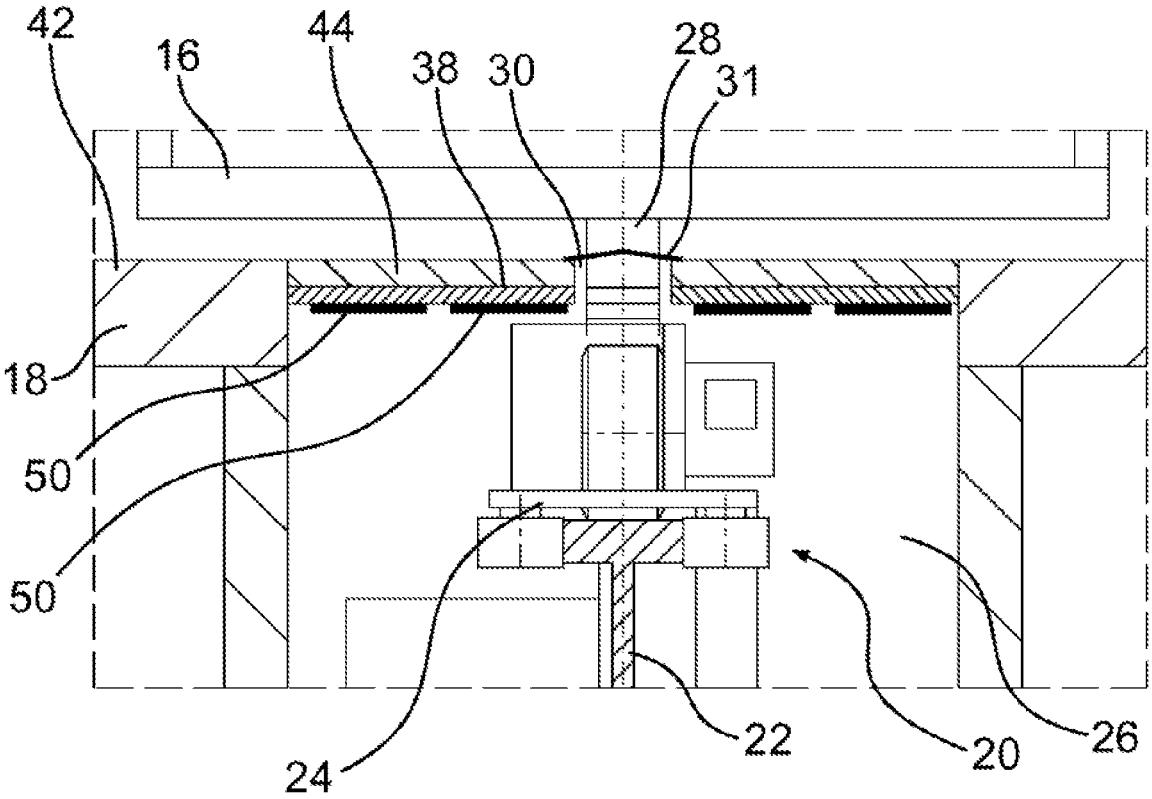
FIG. 5 shows a corresponding detail according to FIG. 3 in accordance with a further illustrative embodiment.

As can be seen from FIG. 2, and in particular from the enlargement details of FIGS. 3 to 5, the intermediate floor 18 has primarily in the inner region, above the tunnel tube of the conveying device 20, a floor portion 38 of roughly wedge-shaped cross section.

According to the invention, it is now provided that the floor portion 38 has at least one cavity 40, in which cooling or heating medium flows. For this, the floor portion 38 is provided with ports (not shown), which allow the cavity 40 to be fed a cooling medium or a heating medium in order, in the here shown example, to flow lengthwise through the floor portion 38 along the direction of conveyance of the conveying device 20.

In this way, in the tunnel tube 26, above all the heat-sensitive parts of the running gear 24, such as a drive wheel or pressure rollers, are protected from excessively high temperatures. In particular, maximum temperatures of 60° C. are not here exceeded.

As can further be seen from FIG. 3, the top side of the floor portion 38 is provided with a slope which, starting from the connecting passage 30, slopes down toward the outside. Moreover, the floor portion 38, in relation to an adjacent portion 42 of the intermediate floor 18, is offset with a stagger, in particular with a stagger of less than 5 cm, in the downward direction. As a result, at the outer end of the floor portion 38 is formed a collecting region 39, in which condensate that, due to the active cooling, condenses out from the air of the temperature control tunnel 12 on the top side of the floor portion 38 can collect.

For the evacuation of the condensate, along the direction of conveyance in the here shown example, drains (not represented) are provided.

FIG. 3 shows an illustrative embodiment in which the floor portion 38 of the intermediate floor 18 is not provided with a slope, but instead bears an insulating layer 44. The insulating layer 44 is here formed of such a material and is dimensioned such that, at the anticipated temperatures which prevail in the temperature control tunnel 12 during the operation of the temperature control apparatus 10 and at the corresponding air humidity values, the dew point of the respective condensate liquid lies inside the floor portion 38 and not on the surface thereof.

Finally, FIG. 5 shows an illustrative embodiment in which the floor portion 38 is designed as a simple supporting plate with the applied insulating layer 44. Furthermore, instead of the cavities 40, Peltier elements 50 are provided, which, electrically actuated, generate a cooling output. The Peltier elements 50 too thereby provide, in the region of the intermediate floor portion 38, an actively cooled structural element as heat shielding from the temperatures of the temperature control tunnel 12. For the design of the floor portion 38, the use of the Peltier elements 50 here allows substantially only the statics of the supporting plate to be taken into account. Cavities and ports for appropriate cooling or heating mediums are not necessary here.

The Peltier elements 50 can also be provided only as supplementary cooling elements in individual regions of the temperature control tunnel 12 in order in this way, for instance, along the direction of conveyance of the temperature control tunnel 12, to provide different cooling and heating outputs, depending on the temperature prevailing in the appropriate region of the temperature control tunnel.

What is claimed is:

1. An apparatus for controlling the temperature of workpieces, comprising:

a) a temperature control tunnel, b) a tunnel tube, c) an intermediate floor, which separates the temperature control tunnel from the tunnel tube and has a connecting passage, and d) a conveying device for conveying the workpieces in the temperature control tunnel, e) wherein the conveying device has at least one trolley having a running gear and a workpiece carrier for receiving the workpieces to be temperature-controlled, wherein the running gear is arranged in the tunnel tube and, with a connecting device which projects through the connecting passage of the intermediate floor, is connected to the workpiece carrier arranged in the temperature control tunnel, and further wherein f) the intermediate floor, at least in some regions, is equipped with an active cooling and/or heating system in order to control a temperature of the tunnel tube, wherein the active cooling and/or heating system comprises a cavity, which is arranged in the intermediate floor and is designed to be flowed through with a cooling or heating medium.

2. The apparatus for controlling the temperature of workpieces, as claimed in claim 1, wherein the active cooling and/or heating system comprises a plurality of cavities, which are arranged in the intermediate floor.

3. The apparatus for controlling the temperature of workpieces, as claimed in claim 2, wherein the plurality of cavities have different flow cross sections.

4. The apparatus for controlling the temperature of workpieces, as claimed in claim 1, wherein the active cooling and/or heating system comprises a Peltier element or a heating element.

5. The apparatus for controlling the temperature of workpieces, as claimed in claim 1, wherein the intermediate floor has a collecting region in which condensate from air of the temperature control tunnel can collect.

6. The apparatus for controlling the temperature of workpieces, as claimed in claim 1, wherein the intermediate floor has an insulating layer.

7. The apparatus for controlling the temperature of workpieces, as claimed in claim 1, wherein the active cooling and/or heating system is designed to control the temperature to differing extent along a direction of conveyance of the conveying device.

8. The apparatus for controlling the temperature of workpieces, as claimed in claim 1, wherein the active cooling and/or heating system is dimensioned such that temperatures of heat-sensitive components of the running gear in the tunnel tube can be limited to a range of maximally 60° C. or minimally 0° C.

9. The apparatus for controlling the temperature of workpieces, as claimed in claim 8, wherein the active cooling and/or heating system is dimensioned such that, at the provided temperatures of the dryer tunnel, the temperatures of heat-sensitive components of the running gear in the tunnel tube can be limited to a range of maximally 40° C. or minimally 20° C.

10. The apparatus for controlling the temperature of workpieces, as claimed in claim 5, wherein the collecting region is a collecting channel.

* * * * *